US012715482B2

(12) United States Patent
Hanl

(10) Patent No.: US 12,715,482 B2
(45) Date of Patent: Aug. 25, 2026

(54) TOW ELEMENT AND METHOD FOR TOWING A BICYCLE WITH A TOW LIFT

(71) Applicant: Simon Hanl, Würflach (AT)

(72) Inventor: Simon Hanl, Würflach (AT)

( * ) Notice: Subject to any disclaimer, the term of this patent is extended or adjusted under 35 U.S.C. 154(b) by 441 days.

(21) Appl. No.: 18/283,520

(22) PCT Filed: Mar. 22, 2022

(86) PCT No.: PCT/EP2022/057436

§ 371 (c)(1),
(2) Date: Sep. 22, 2023

(87) PCT Pub. No.: WO2022/200317

PCT Pub. Date: Sep. 29, 2022

(65) Prior Publication Data

US 2024/0166247 A1 May 23, 2024

(30) Foreign Application Priority Data

Mar. 24, 2021 (NO) ..... 20210382
Sep. 22, 2021 (NO) ..... 20211137

(51) Int. Cl.
*B61B 11/00* (2006.01)

(52) U.S. Cl.
CPC ..... *B61B 11/006* (2013.01)

(58) Field of Classification Search
CPC ..... B61B 11/00; B61B 11/004; B61B 11/006
See application file for complete search history.

(56) References Cited

U.S. PATENT DOCUMENTS

2020/0398099 A1 12/2020 Landis

FOREIGN PATENT DOCUMENTS

| | | | | |
|---|---|---|---|---|
| CH | 462 875 | A | 9/1968 | |
| DE | 299 14 106 | U1 | 4/2000 | |
| DE | 19856755 | C2 * | 5/2002 | ..... B61B 11/006 |
| DE | 198 56 755 | A1 | 6/2020 | |
| EP | 2914469 | B1 | 3/2017 | |
| EP | 1373043 | A1 | 1/2024 | |
| WO | WO-2006083838 | A2 * | 8/2006 | ..... B62K 13/06 |
| WO | 2014068328 | A1 | 5/2014 | |

OTHER PUBLICATIONS

Simon Hanl, "International Search Report for PCT/EP2022/057436", Sep. 8, 2022, 3 pages.
Simon Hanl, "Norwegian Search Report for Norwegian Patent Appln. No. 20211137", Feb. 10, 2022, 2 pages.

* cited by examiner

*Primary Examiner* — Robert J McCarry, Jr.
(74) *Attorney, Agent, or Firm* — F. Brent Nix, Esq.; Johnson, Marcou, Isaacs & Nix, LLC; Ming Zhang

(57) ABSTRACT

The present invention concerns a tow element (1) for coupling a tow lift to a bicycle. The tow element (1) comprises a tube (1*c*) and a tow loop (1*a*), extending from one end of the tube (1*c*) and configured to be hooked onto the stem (3*a*) of a bicycle. The tow element further comprises a connector (1*d*), extending from the opposite end of the tube (1*c*) and configured to connect the tow element (1) to the tow lift.

17 Claims, 8 Drawing Sheets

TOW ELEMENT AND METHOD FOR TOWING A BICYCLE WITH A TOW LIFT

TECHNICAL FIELD

Figure 1A:
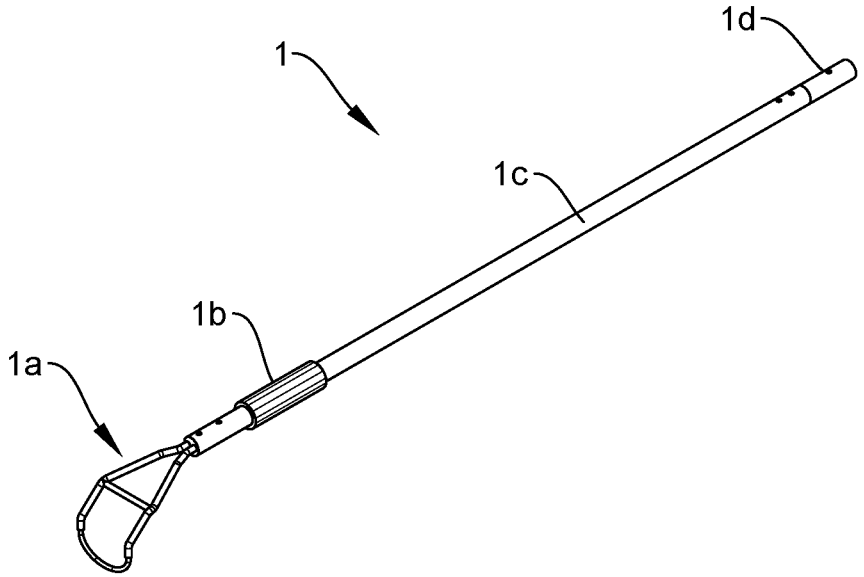

The present invention concerns a tow element for coupling a tow lift to a bicycle, a method for towing of a bicycle with a tow lift, a method for producing a tow element and a method for converting a tow lift.

BACKGROUND

Downhill cycling, on bicycles such as off-road bicycles, mountain bikes, snow bikes, fat bikes or all-terrain bicycles (ATB's), enjoys an ever-increasing popularity. In order to arrive at the uphill starting point for a downhill ride, the bicycle and cyclist need to be transported uphill. Preferably, existing infrastructure is used thereto, such as tow lifts, originally intended for skiers. Such a tow lift transports a skier uphill by towing, where the skier glides uphill while holding on to, or being supported by a tow element of the tow lift. The tow element may be rope-shaped, loop-shaped, T-shaped, J-shaped, or disk-shaped. Each tow element is suspended from a recoiling cable, tensioning the tow element when in use and vertically retracting the tow element when not in use. To tow a bicycle with mounted cyclist, the tow lift must be converted, by adapting or replacing the tow elements thereof. With such a converted tow lift, the bicycle can be towed uphill, with the cyclist remaining seated on the bicycle. During uphill towing, the cyclist must steer and balance the bicycle.

Known tow lift conversions utilize tow elements shaped as clamps or hooks. The clamp or hook may be clamped or hooked onto one or more parts of a bicycle, such as the frame, the steering column, the steering bar, or the saddle bar. Thereby the bicycle and mounted cyclist can be towed uphill, while the wheels of the bicycle remain in contact with the ground surface.

A major danger during the uphill towing of a bicycle with mounted cyclist, is that the bicycle may become unstable. Instability may, for instance, occur due to the rough terrain or due to the cyclist losing control over the bicycle. When instability occurs during towing, it is imperative that the bicycle is released from the tow lift as quickly as possible. Otherwise, the bicycle with mounted cyclist could fall over, while continuing to be towed uphill, thereby risking material damage to the bicycle and/or physical injury to the cyclist. Additionally, it is advantageous that the bicycle can swiftly be released from the tow lift when arriving at the uphill end station thereof. However, no prior tow element conversion provides a satisfactory level of safety by allowing a swift and reliable release from the tow lift.

Consequently, there is a clear and urgent need to provide improved means for coupling a bicycle to a tow lift, whereby the bicycle and mounted cyclist can quickly and reliably be released from the tow lift when arriving at the uphill tow lift end station or when instability occurs during towing and a fall is imminent.

SUMMARY OF THE INVENTION

The present invention concerns a tow element for coupling a tow lift to a bicycle, the tow element characterized by comprising:

a tube;

a tow loop, extending from one end of the tube and configured to be hooked onto the stem of a bicycle;

a connector, extending from the opposite end of the tube and configured to connect the tow element to the tow lift; and wherein the tow loop comprises two side portions and a loop portion, connecting the end parts of the side portions to form a loop shape.

In another aspect, the present invention concerns a method for converting a tow lift, the method comprising:

providing a tow lift with at least one recoiling cable; and connecting the least one recoiling cable to the connector of a tow element according to any one of claims 1-10.

In yet another aspect, the present invention concerns a method for towing a bicycle with a tow lift according to claim 11, the method comprising:

hooking a tow loop onto the stem of the bicycle;

towing the bicycle and mounted cyclist uphill; and releasing the tow loop from the stem by pulling the tube and unhooking the tow loop.

In yet another aspect, the present invention concerns a method for producing a tow element according to any of claims 1-10, the method comprising:

providing a tow loop, a tube and a connector;

coupling the tow loop to one end of the tube and coupling the connector to the opposite end of the tube.

FIGURES

FIG. 1 a schematically shows a tow element according to the invention.

Figure 1B:
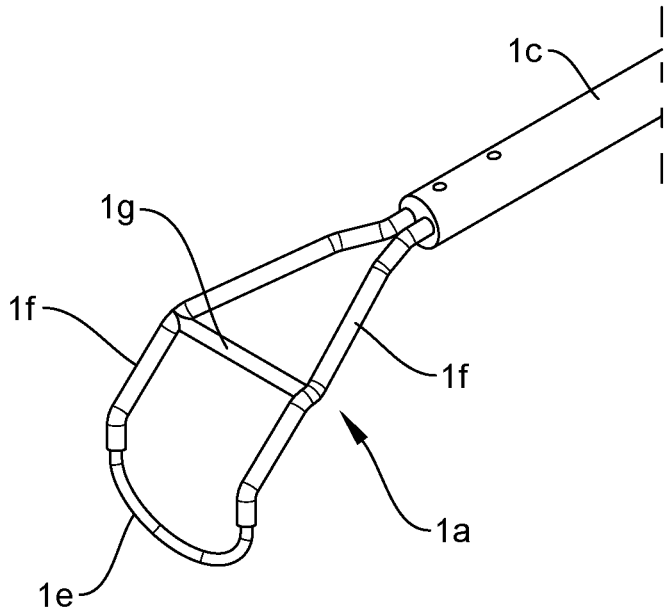

FIG. 1*b* schematically shows a detail of a tow element according to the invention.

Figure 1C:
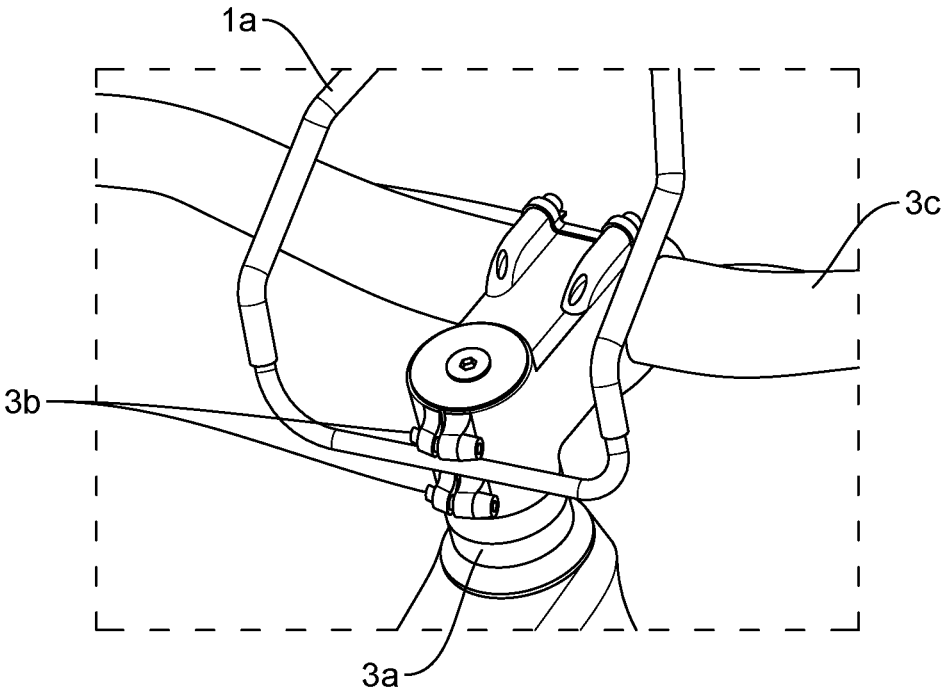

FIG. 1*c* schematically shows a sideview of a bicycle stem with a tow element according to the invention coupled thereto.

Figure 1D:
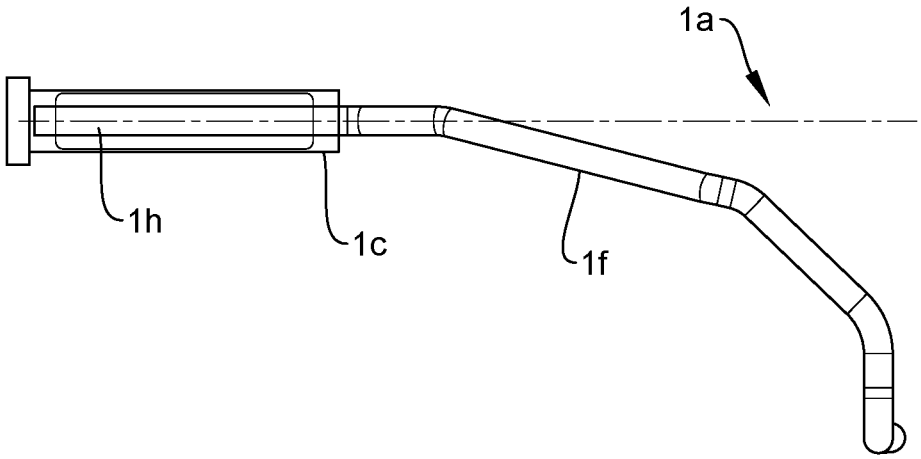

FIG. 1*d* schematically shows a side view of a detail of a tow element according to the invention.

Figure 1E:
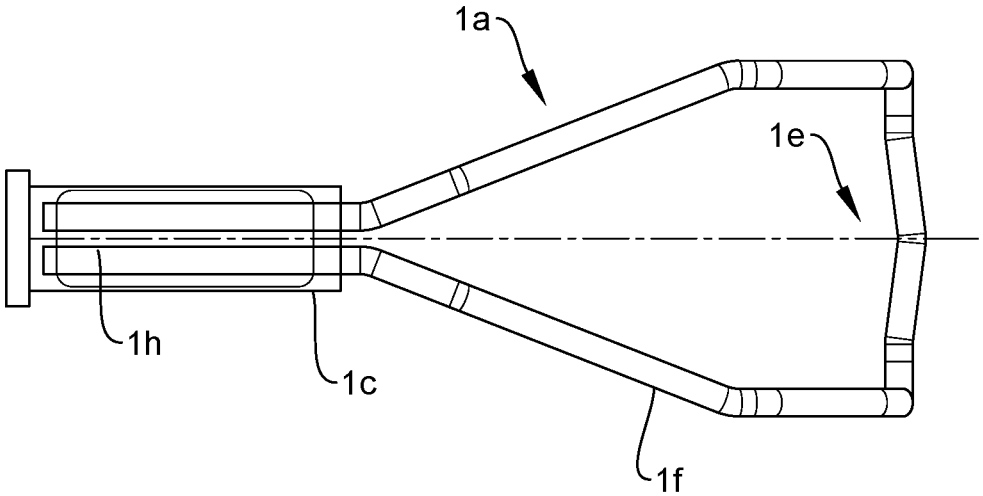

FIG. 1*e* schematically shows a top view of a detail of a tow element according to the invention.

Figure 1F:
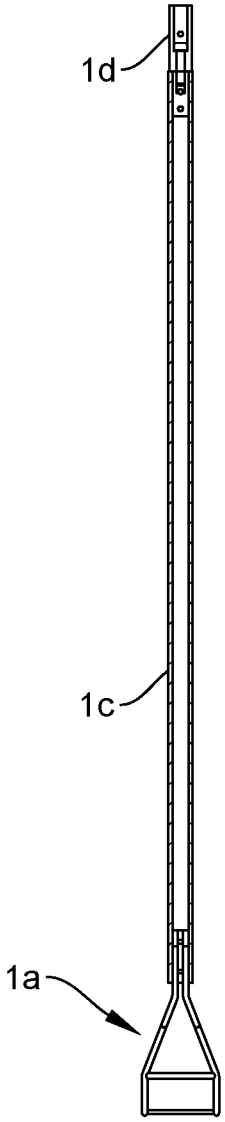

FIG. 1*f* schematically shows a top view of a tow element according to the invention.

Figure 1G:
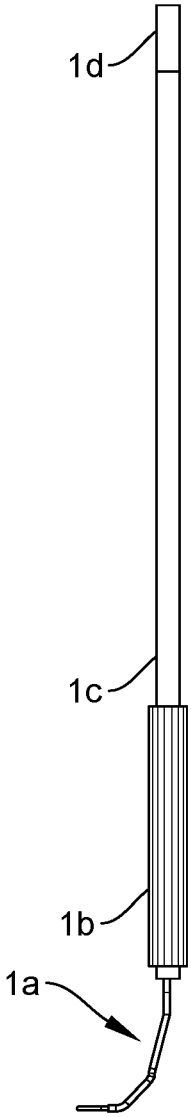

FIG. 1*g* schematically shows a side view of a tow element according to the invention.

Figure 1H:
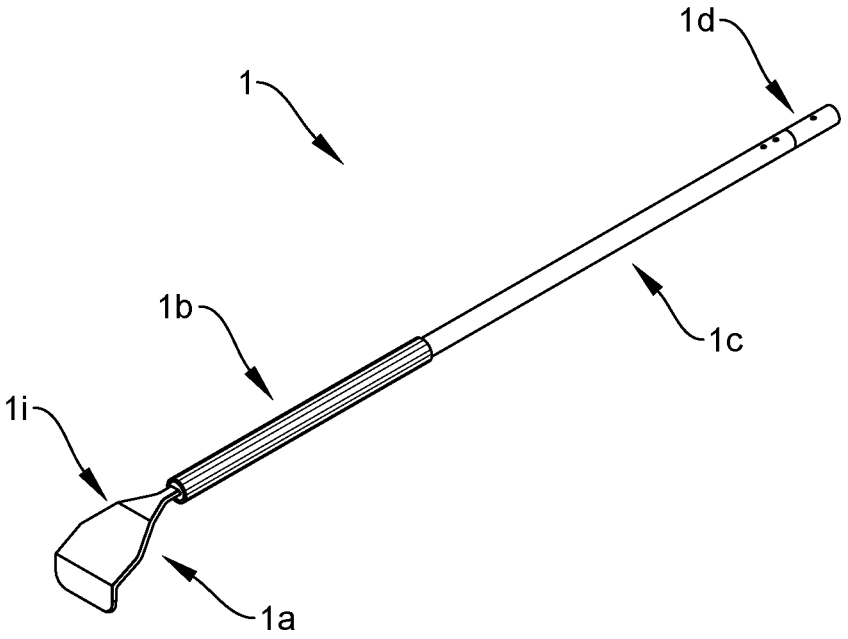

FIG. 1*h* schematically shows a tow element with sleeve according to the invention.

Figure 2A:
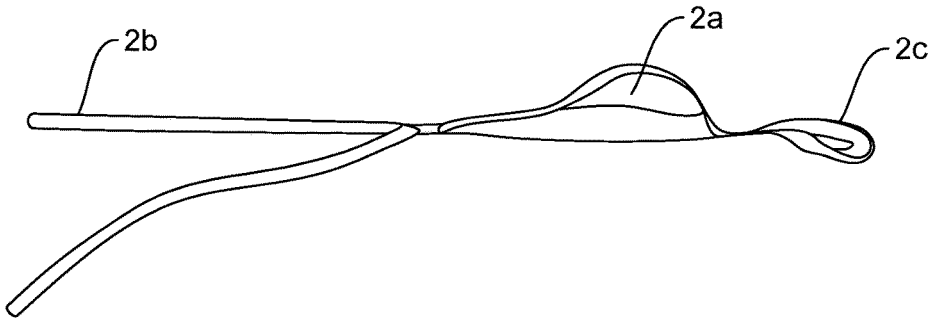

FIG. 2*a* schematically shows a stem part of a harness according to the invention.

Figure 2B:
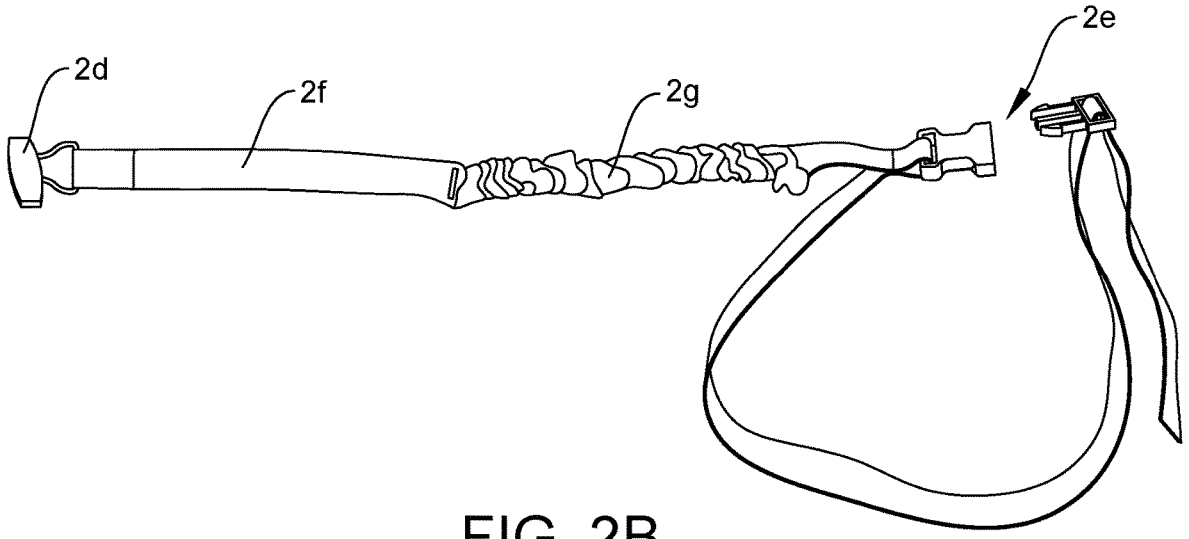

FIG. 2*b* schematically shows a waist part of a harness according to the invention.

Figure 3B:
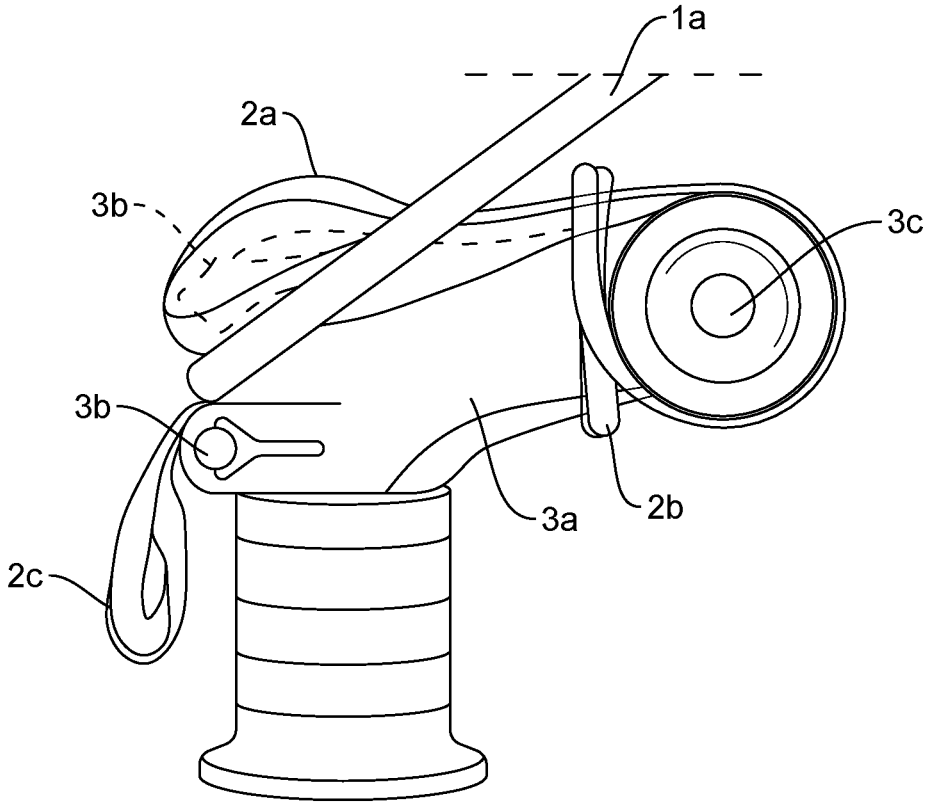

FIG. 3*b* schematically shows a sideview of a bicycle stem with a stem part of a harness and a tow loop according to the invention coupled thereto.

Figure 3C:
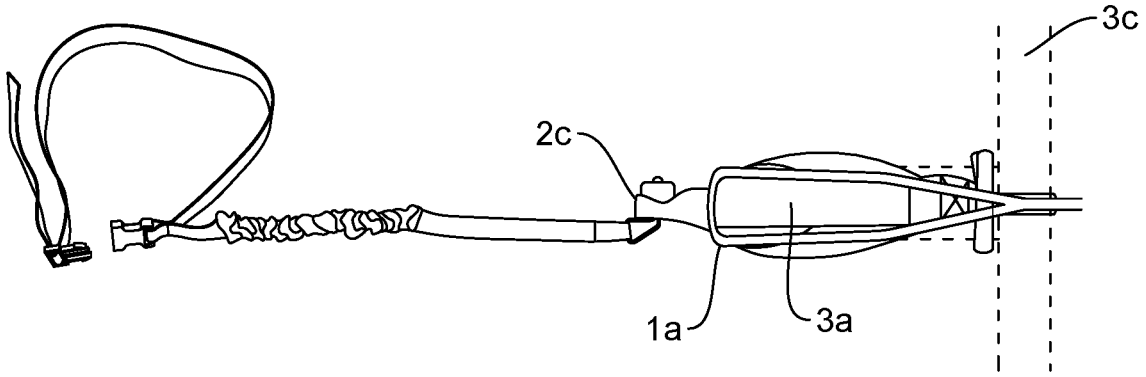

FIG. 3*c* schematically shows a top view of a waist part stem part of a harness coupled to the stem part of a harness.

Figure 4A:
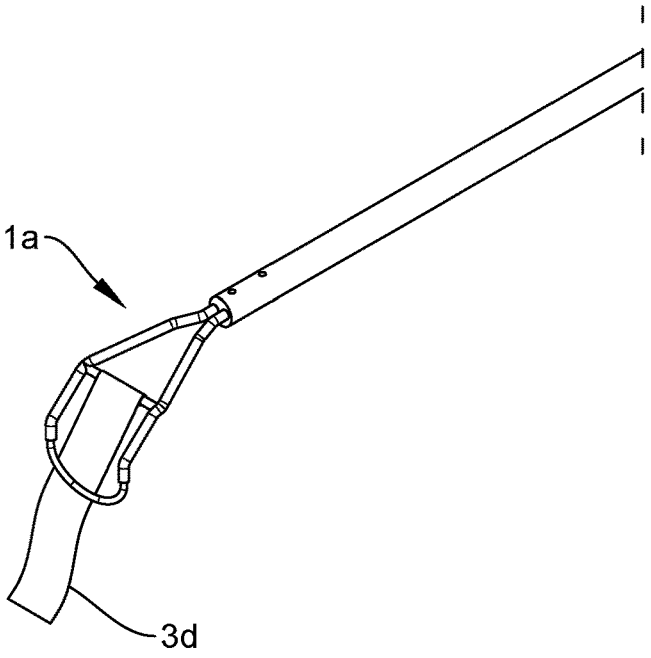

FIG. 4*a* schematically shows a tow element with a release tab.

Figure 4B:
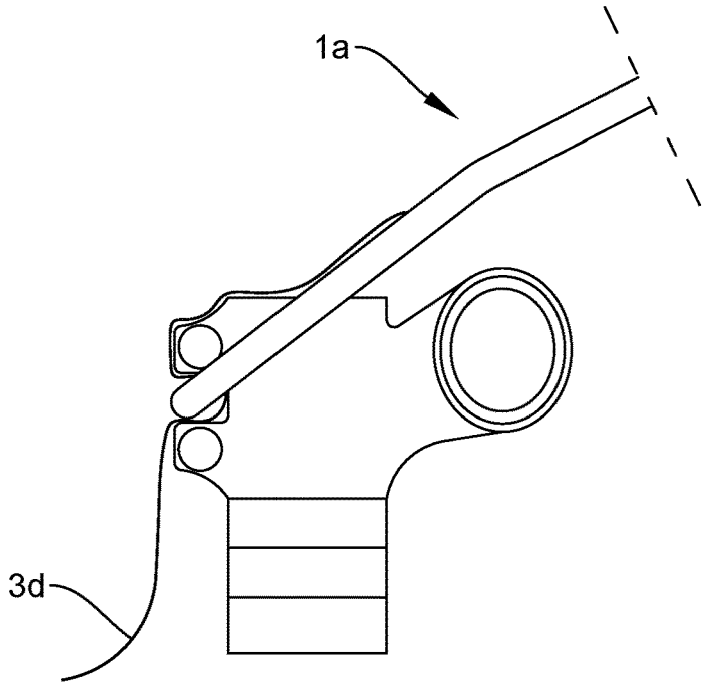

FIG. 4*b* schematically shows a sideview of a stem and a release tab, with a tow loop coupled thereto.

DETAILED DESCRIPTION

A tow element 1 according to the invention is schematically shown in FIGS. 1*a*-1*h*, where the same reference signs denote the same features. The tow element 1 is configured to couple a tow lift to a bicycle. The bicycle is preferably suitable for off-road downhill cycling such as a mountain bike, snow bike, fat bike or all terrain bike. Advantageously, the tow element transfers the dragging force from the tow lift to the bicycle. The bicycle and a mounted cyclist are then towed by the tow lift, with the bicycle rolling uphill. As schematically shown in FIG. 1*a*, the tow element 1 comprises a tow loop 1*a*, shown in more detail in FIG. 1*b*, an optional grip 1*b*, a tube 1*c* and a connector 1*d*, detailed below. The tow loop 1*a* is configured to be hooked onto the stem 3*a* of the bicycle, as shown in FIG. 1*c*. The stem 3*a* is preferably a threadless stem. In a threadless configuration, the steering tube has no thread onto which the stem is screwed. The steering tube is attached to the fork of the bicycle. The stem 3*a* connects the handlebar 3*c* of the bicycle to the steering column, where the steering column comprises the fork and steering tube. In the threadless configuration, the stem 3*a* is clamped onto the steering column with one or more stem bolts 3*b*. The lengthwise axis of the one or more stem bolts 3*b* is roughly parallel to the handlebar 3*c* and perpendicular to the steering column. When the tow loop 1*a* is hooked onto the stem 3*a*, the tow loop 1*a* is additionally hooked onto a stem bolt 3*b*. The dragging force exerted by the tow lift tensions the tow loop 1*a*, thereby maintaining the tow loop 1*a* in place on the stem 3*a* during towing.

The tow loop 1*a* comprises a loop portion 1*e* and two side portions 1*f*. The loop portion 1*e* connects the end parts of the side portions 1*f* to form a loop shape, shown in FIGS. 1*b* and 1*n* more detail in FIGS. 1*d* and 1*e*. The tow loop 1*a* may further comprise at least one cross-rib 1*g*, connecting the two side portions 1*f*. Preferably, the tow loop 1*a* comprises two cross-ribs, spaced apart along the side portions 1*f*. Advantageously, the side portions 1*f* and the optional at least one cross-rib 1*g* provide stiffness and form-stability to the tow loop 1*a*. The tow loop 1*a* provides sufficient tensile strength to tow a bicycle and mounted cyclist uphill.

The side portions 1*f* are partially inserted into the tube 1*c* and fixed in place, as schematically shown in FIGS. 1*d* and 1*e*. Preferably, the side portions 1*f* are fixed in place by a clamping piece 1*h*. An end portion of each side portion 1*f* is inserted in an opening in the clamping piece 1*h*. Preferably, each opening I the clamping piece 1*h* for receiving an end portion is a through-opening. The end portions of the side portion 1*f* may be clamped, glued, mechanically fastened, or welded in place in the clamping piece 1*h*. The clamping piece 1*g* may be fixed into place in the tube 1*c*, for instance by gluing, welding, clamping, and/or by a mechanical connection. The mechanical connection may be a screw connection or a rivet connection. The clamping piece 1*h* may comprise a polymer material, such as polyethylene, polyvinylchloride, or polypropylene. Alternatively, the clamping piece 1*h* may comprise a metal, or a composite material.

As schematically shown in the side view of FIG. 1*d*, i.e., in the plane roughly perpendicular to the loop portion 1*e*, the side portions 1*f* extending from the tube 1*c* may be angled, or curved, with respect to the longitudinal axis of the tube 1*c* (dash-dotted line in FIG. 1*d*). The end section of each side portion 1*f*, may extend at an angle with the longitudinal axis of the tube 1*c* of 90°-130°, preferably 91°-120°, more preferably 92°-110°. Advantageously, by providing end portions extending at an angle with the longitudinal axis of the tube, both hooking and unhooking of the tow loop onto a bicycle-stem is improved and the risk of the tow loop accidentally hooking onto other parts of the bicycle is reduced. As schematically shown in the top view of FIG. 1*e*, i.e., in the plane roughly parallel to the loop portion 1*e*, the side portions may extend from the tube 1*c* at an angle, or curved, with respect to the longitudinal axis of the tube 1*c* (dash-dotted line in FIG. 1*e*). The side portions may extend at an angle with the longitudinal axis of the tube 1*c* of 5°-30°, preferably 10°-20°. The end portions of each side portion 1*f* may preferably extend parallel to the longitudinal axis of the tube 1*c*. Advantageously, a wide loop-shape is thereby formed, allowing the tow loop to be hooked onto threadless bicycle-stems with different shapes, such as an ahead stem, or a direct mount stem.

The tow loop 1*a* may comprise a metal, such a metal tube or metal rod. Alternatively, the side portions 1*f* may comprise metal tubes and the loop portion 1*e* may comprise a metal wire cord, where the metal wire cord is threaded through the tubes of the side portions 1*f*. A polymer coating or sleeve may be provided on the tow loop 1*a*, to improve impact damping and to protect the bicycle stem and the tow loop 1*a* from scratches. Alternatively, the tow loop 1*a* may comprise a polymer, such as a molded polymer part. The molded polymer part may be reinforced with glass fibers or carbon fibers.

The tow element 1 may optionally comprise a release tab. The release tab is configured to be clamped between the tow loop 1*a* and the stem 3*a*. At one end, the release tab is fixed to the tow loop 1*a*. The other end of the release tab is a free end. Advantageously, when losing balance during towing or when arriving uphill, a cyclist may grab the free end of the release tab and tension the release tab. Due to the release tab being clamped between the tow loop 1*a* and the stem 3*a*, a tensioning of the release tab unhooks the tow loop 1*a* from the stem 3*a* and tips the tow loop 1*a* over the stem 3*a*. Thereby, the tow loop 1*a* is quickly and reliably released from the stem 3*a* and the bicycle is released from the tow lift.

The release tab may comprise a webbing, preferably of a polymer material, such as a nylon, propylene, or polyester. The release tab is preferably fixed to the at least one cross-rib 1*g*. Thereto, one end of the release tab may be wrapped around the at least one cross rib 1*g* and fixed in place by means of Velcro or by being sewing. Advantageously, by releasably fixing the release tab with Velcro the release tab can easily be replaced. The free end of the release tab may be stiffened, by a stiffening member or by being fixed in a double folded state. Advantageously, the stiffened free end can more easily be grabbed.

The tube 1*c*, schematically shown in length-wise cross-section in FIG. 1*d* and schematically shown from outside in FIG. 1*e*, may be hollow or piece-wise hollow. The length of the tube 1*c* may be adapted to the height of the tow lift above the ground and the length of the recoiling cables of the tow lift. The tow loop 1*a* extends from one end of the tube 1*c*. The tow loop 1*a* may be hooked onto the stem 3*a*, or unhooked from the stem 3*a*, by grabbing and pulling the tube 1*c*. Advantageously, when a fall is imminent during uphill towing or when arriving at the uphill station, the tow loop may thereby quickly and reliably be released from the stem 3*a*.

The optional grip 1*b* is placed at or near the end of the tube 1*c* from which the tow loop 1*a* extends. The grip 1*b* may be placed such that one end of the grip 1*b* coincides with the end of the tube 1*c*. Alternatively, the grip 1*b* may be placed such that one end of the grip 1*b* is distanced from the end of the tube 1*c*. The grip 1*b* may be formed as a sleeve, as a winding, as an extruded part, as a one-piece moulded part, or as a multi-piece moulded part. The grip 1*b* may be held in place on the tube 1*c* by elastic tension, by mechanical fastening means and/or by an adhesive. The grip 1*b* may comprise a rubber material, such as a neoprene rubber, a silicone material, a fabric material, a polymer foam material, or a solid polymer material. The solid or foamed polymer material may comprise polyethylene, polypropylene, polyvinylchloride, thermoplastic polyurethane, or any other suitable polymer. The grip 1*b* may be formed with one or more bulges, to improve holding comfort and purchase for a user. The grip 1*b* may further comprise a patterned or roughened outer surface, to improve grabbing friction of the grip 1*b*. Advantageously, the grip provides improved friction for secure grabbing and pulling of the tube, during hooking and unhooking of the tow loop, as well as improved comfort during grabbing and holding. Preferably, the grip 1*b* comprises a vibrant color such as red, orange, or yellow. It is thereby quickly seen where the tube 1*c* should be grabbed, which is especially advantageous in situations where a fall is imminent and fast unhooking of the tow loop is required.

The tow element 1 also comprises a connector 1*d*, configured to connect the tow element 1 to a recoiling cable of a tow lift. The connector 1*d* is connected to the end of the tube 1*c*, opposite to the tow loop 1*a*. The connector 1*d* may be connected to the tube 1*c* so as to be freely rotatable around the longitudinal axis of the tube 1*c*. Alternatively, the connector 1*d* may be connected to tube 1*c* by a fixed, non-rotating connection. The connector may be connected to the tube 1*b* by means of a mechanical connection, a spring-loaded connection, by gluing or by welding. The connector 1*d* may be partially inserted in the tube 1*c*, as schematically shown in FIG. 1*f*, partially inserted over the tube 1*c*, or may form an integral part of the tube 1*c*. The connector 1*d* may comprise a screw thread, configured to be connected in a screw connection with the connection part of a recoiling cable of a tow lift. The screw thread may preferably be an M16, or M20, fine screw thread, with a 1.5 mm thread pitch. Alternatively, the connector 1*d* may comprise an adaptor coupling, which may be slid over or into the connection part of a recoiling cable of a tow lift. The adaptor coupling may then be held in place by clamping, a spring-loaded connection, or a screw-in-place connection.

The tow loop 1*a*, the tube 1*c*, the clamping piece and the connector 1*d* may each comprise the same or different materials, such as a metal, a polymer, or a composite material. Suitable metals are aluminum or anodized aluminum, galvanized steel, or stainless steel. Suitable polymers are acrylonitrile butadiene styrene, polycarbonate, polyethylene, or polypropylene. Suitable composites are glass fiber polymer composite or carbon fiber polymer composite. Preferably, the tube 1*c* and the connector 1*d* comprise aluminum or anodized aluminum and the clamping piece comprises a polyethylene.

The tow element 1 may further comprise a sleeve 1*i*, schematically shown in FIG. 1*h*. The sleeve 1*i* may comprise a webbing material or an elastic fabric, such as a neoprene. The sleeve 1*i* is configured to cover the tow loop 1*a*. The sleeve 1*i* may be secured to the tow loop 1*a* by elastic clamping, by Velcro or by a fastener cord. Advantageously, the sleeve 1*i* prevents the tow loop 1*a* from undesirably hooking onto an element of the bicycle when the tow loop 1*a* is attached-to or released-from the bicycle. The tow element 1*a* may further comprise a protective tab (not shown). The protective tab comprises at least one layer of a wear-resistant material, such as a nylon webbing, a canvas piece, or a neoprene patch. The protective tab covers or partially covers the loop portion 1*e*. The protective tab may be fixed in a loop shape around the loop portion 1*e* and the cross-rib 1*g*. The protective tab may be held in the loop shape by Velcro or may be sewn into the loop shape. Alternatively, one end of the protective tab may be fixed to one side of the sleeve 1*i*, by sewing or Velcro. The other end of the protective tab may be fixed to the other side of the sleeve 1*i*, by Velcro, after the sleeve 1*i* is installed on the tow loop 1*a*. Advantageously, the protective tab provides impact damping and protects both the stem and the tow loop from scratches.

A system for coupling a tow lift to a bicycle comprises the tow element 1 and may further comprise a harness. The harness comprises a stem part, schematically shown in FIG. 2*a*, and a waist part, schematically shown in FIG. 2*b*. Advantageously, the harness provides additional safety during uphill towing, for instance for smaller cyclists, such as children. The harness preferably comprises a webbing material, such as a nylon, propylene, or polyester.

The stem part is configured to be installed on the stem 3*a* of a bicycle, as detailed below. The stem part comprises a main loop 2*a* and one or more fastening ribbons 2*b* extending from the main loop. Preferably two fastening ribbons are provided. The one or more fastening ribbons 2*b* may be provided with connection means, such as Velcro strips or a side release buckle. Advantageously, the connection means can easily be adjusted to different stem sizes and shapes. The stem part may further comprise a coupling means 2*c*, such as a loop.

The waist part comprises a closeable loop, configured to be fastened around the waist of a cyclist. The closeable loop comprises closing means 2*e*, such a side release buckle, Velcro strips, a two-part clasp or a hook and loop fastener. Preferably, the closing means 2*e* allow the closeable loop to be adjusted to the waist-size of the cyclist. The waist part further comprises a coupling ribbon 2*f*, extending from the closeable loop, and coupling means 2*d*, fixed to the coupling ribbon 2*f* and configured to couple the coupling ribbon 2*f* to the stem part. The coupling ribbon 2*f* may further comprise an elastic portion 2*g*, comprising an elastic material, such as rubber or elastane. Advantageously, the elastic portion 2*g* allows a mounted cyclist to adjust sitting position without being immediately restrained by the harness. The coupling means 2*d* may be a hook or a carabiner, configured to hook into the coupling loop 2*c*. Alternatively, a side release buckle, Velcro strips, or a two-part clasp may be provided.

A tow lift according to the invention comprises a plurality of recoiling cables and at least one tow element according to the invention. At least one of the recoiling cables is connected to a tow element 1. The recoiling cable is connected to the connector 1*d* of the tow element 1.

A method for towing a bicycle with a tow lift comprises providing a plurality of recoiling cables and at least one tow element 1 according to the invention. The tow loop 1*a* is hooked onto the stem 3*a* of the bicycle, schematically shown in a side view in FIG. 3*b* and in a top view in FIG. 3*c*. The tow loop 1*a* is hooked onto the stem 3*a* over the stem bolt 3*b*. If the optional release tab is provided, the release tab is clamped between the tow loop 1*a* and the stem 3*a*. The free end of the release tab 3*d* extends from between the tow loop 1*a* and the stem 3*a* and can readily be grabbed. Thereafter, the bicycle with mounted cyclist is towed uphill by the tow lift. When instability occurs during towing, or when arriving at uphill, the cyclist unhooks the tow loop 1*a* by grabbing the tube 1*c*, or optionally by grabbing the grip 1*b*, and pulling the tow loop 1*a* over the stem 3*a* and stem bolt 3*b*. Optionally, the free end of the release tab may be grabbed to unhook the tow loop 1*a* from the stem 3*a*. Thereby, the tow loop 1*a* is quickly and reliably released from the stem 3*a* and the bicycle is released from the tow lift. The optional sleeve 1*e* prevents the tow loop 1*a* from unintentionally hooking onto other parts of the bicycle during installing or release.

Additionally, the bicycle and cyclist may be coupled by the harness. Thereto, the stem part is installed on the stem 3*a*, schematically shown in sideview in FIG. 3*b*. The main loop 2*a* may be hooked around the stem and a stem bolt 3*b*. In FIG. 3*b* one stem bolt is visible, whereas the second stem bolt (indicated with dashed line) is covered by the stem part. The one or more fastening ribbons 2*b* may then be led around the handlebar 3*c*, back to the stem 3*a* and then crossed over itself or one another, to be fixed with the connection means. Thereby, the stem part is securely held in place, with the coupling loop 2*c* extending towards the saddle of the bicycle. The waist part is fastened around the waist of the cyclist. The stem part and the waist part are then coupled by the coupling means 2*d*, before or after the cyclist is mounted on the bicycle. A coupled waist part and stem part are schematically shown in a top view in FIG. 3*c*. The tow loop 1*a* is then hooked onto the stem 3*a* and over the stem bolt 3*b*, such that the stem part is clamped between the tow loop 1*a* and the stem 3*a*. By tensioning and pulling the coupling ribbon 2*f* upwards, the cyclist may unhook the tow loop 1*a* by tipping the tow loop 1*a* over the stem 3*a* and stem bolt 3*b*. Thereby the bicycle is released from the tow lift. Advantageously, the harness thereby provides a further means to release the bicycle quickly and reliably from the tow lift, thereby providing further safety, especially for smaller cyclists, such as children.

A method for producing a tow element 1 comprises providing a tow loop 1*a*, wherein the tow loop 1*a* may comprise a metal or a polymer. A metal tow loop 1*a* may be formed by stamping or bending metal tubes or metal rods to form the side portions 1*f*, the loop portion 1*e* and optionally, the at least one cross-rib 1*g*. The at least one cross-rib 1*g* and loop portion 1*e* may then be welded onto the side portions 1*f*. Alternatively, the side portions 1*f* may comprise metal tubes and the loop portion 1*e* may comprise a metal wire cord, which is threaded through the side portions 1*f*. A polymer coating or sleeve may next be applied to the tow loop 1*a*. A polymer tow loop 1*a* may be formed by injection molding the side portions 1*f*, loop portion 1*e* and the at least one cross-rib 1*g* as a single polymer part. The polymer may be reinforced with glass fibers or carbon fibers.

The method for producing a tow element 1 further comprises providing a tube 1*c* and a connector 1*d*. The tow loop 1*a* is coupled to one end of the tube 1*c*. Preferably an end portion of the side portions 1*f* are inserted into a clamping piece 1*h* and fixed thereto. The clamping piece 1*h* with inserted side portions 1*f* is next placed in one end of the tube 1*c* and fixed thereto. The connector 1*d* is formed or coupled to the opposite end of the tube 1*c*. Preferably, the connector 1*d* is coupled to the tube 1*c* to be freely rotatable around the longitudinal axis of the tube 1*c*.

A method for converting a tow lift comprises providing a tow lift with at least one recoiling cable and providing the at least one recoiling cable with a tow element 1 according to the invention. Coupling the tow element 1 comprises coupling the connector 1*d* of the tow element 1 to the end part of a recoiling cable. The connecter 1*d* may be coupled to the recoiling cable by a crew connection or by means of an adaptor coupling.

LIST OF REFERENCES

1 tow element
1*a* tow loop
1*b* grip
1*c* tube
1*d* connector
1*e* loop portion
1*f* side portion
1*g* cross-rib
1*h* clamping piece
1*i* sleeve
2*a* main loop
2*b* ribbon
2*c* coupling loop
2*d* coupling means
2*e* closing means
2*f* coupling ribbon
2*g* elastic portion
3*a* stem
3*b* stem bolt
3*c* Handlebar
3*d* Release tab

The invention claimed is:

1. A tow element for coupling a tow lift to a bicycle, the tow element (1): comprising:

a tube;

a tow loop extending from one end of the tube and configured to be hooked onto the stem of a bicycle, wherein the tow loop comprises two side portions and a loop portion connecting the end parts of the side portions to form a loop shape; and a connector extending from the opposite end of the tube and configured to connect the tow element to the tow lift; and a grip, placed at the end of the tube from which the tow loop extends, the grip being configured to be grabbed and pulled to release the tow loop from the stem.

2. The tow element of claim 1, wherein the tow loop comprises at least one cross-rib connecting the two side portions.

3. The tow element of claim 1, wherein an end portion of each side portion may extend at an angle with the longitudinal axis of the tube of 90°-130°, in the plane transversal to the loop portion.

4. The tow element of claim 1, wherein an end portion of each side portion may extend at an angle with the longitudinal axis of the tube of 91°-120° in the plane transversal to the loop portion.

5. The tow element of claim 1, wherein an end portion of each side portion may extend at an angle with the longitudinal axis of the tube of 92°-110° in the plane transversal to the loop portion.

6. The tow element of claim 1, wherein the tow loop comprises a polymer.

7. The tow element of claim 1, wherein the tow loop comprises a metal, the metal optionally comprising a polymer coating.

8. The tow element of claim 7, wherein the metal comprises a polymer coating.

9. The tow element of claim 1, wherein the side portions are fixed in place in the tube by a clamping piece.

10. The tow element of claim 1, wherein the grip is formed as a sleeve and wherein the sleeve is fitted over the tube.

11. The tow element of claim 1, wherein the connector is coupled to the tube opposite the tow loop and is configured to connect the tow element to a recoiling cable of a tow lift.

12. The tow element of claim 1, wherein the connector is connected to the tube to be freely rotatable around the longitudinal axis of the tube.

13. The tow element of claim 1, wherein the tow element further comprises a sleeve, covering the tow loop.

14. A tow lift comprising:

at least one recoiling cable, wherein the at least one recoiling cable is provided with a tow element comprising:

a tube;

a tow loop, extending from olne end of the tube and configured to be hooked onto the stem of a bicycle; and a connector, extending from the opposite end of the tube and configured to connect the tow element to the tow lift, wherein the tow loop comprises two side portions and a loop portion, connecting the end parts of the side portions to form a loop shape; and a grip, placed at the end of the tube from which the tow loop extends, the grip being configured to be grabbed and pulled to release the tow loop from the stem.

15. A method for converting a tow lift, the method comprising:

providing a tow lift with at least one recoiling cable; and connecting the least one recoiling cable to a connector of a tow element, wherein the tow element comprises:

a tube;

a tow loop extending from one end of the tube and configured to be hooked onto the stem of a bicycle, wherein the tow loop comprises two side portions and a loop portion, connecting the end parts of the side portions to form a loop shape; and a connector, extending from the opposite end of the tube and configured to connect the tow element to the tow lift; and a grip, placed at the end of the tube from which the tow loop extends, the grip being configured to be grabbed and pulled to release the tow loop from the stem.

16. A method for towing bicycles with a tow lift, comprising:

hooking a tow loop onto a stem of a bicycle, wherein the tow loop is connected to a tube having a grip at the end from which the tow loop extends, and comprises two side portions and a loop portion, connecting the end parts of the side portions to form a loop shape;

towing the bicycle and mounted cyclist uphill; and releasing the tow loop from the stem by grabbing the grip and pulling the tube and unhooking the tow loop.

17. A method for producing a tow element, comprising:

providing a tow loop, a tube, a grip and a connector, wherein the tow loop extends from one end of the tube and is configured to be hooked onto the stem of a bicycle, the tow loop comprising two side portions and a loop portion connecting the end parts of the side portions to form a loop shape, and the connector extending from the opposite end of the tube and configured to connect the tow element to the tow lift; and coupling the tow loop to one end of the tube; and coupling the grip to the end of the tube from which the tow loop extends; and coupling the connector to the opposite end of the tube.

* * * * *